US008109356B2

(12) United States Patent
Brock et al.

(10) Patent No.: US 8,109,356 B2
(45) Date of Patent: Feb. 7, 2012

(54) AUXILIARY HYDRAULIC FLOW CONTROL SYSTEM FOR A SMALL LOADER

(75) Inventors: Timothy John Brock, Bismarck, ND (US); Troy David Kraft, Bismarck, ND (US)

(73) Assignee: Clark Equipment Company, West Fargo, ND (US)

( * ) Notice: Subject to any disclaimer, the term of this patent is extended or adjusted under 35 U.S.C. 154(b) by 640 days.

(21) Appl. No.: 12/236,641

(22) Filed: Sep. 24, 2008

(65) Prior Publication Data

US 2009/0078488 A1 Mar. 26, 2009

Related U.S. Application Data

(60) Provisional application No. 60/974,519, filed on Sep. 24, 2007.

(51) Int. Cl.
*B60K 17/00* (2006.01)

(52) U.S. Cl. ..... 180/305; 180/306; 180/308

(58) Field of Classification Search ..... 180/305, 180/306, 307, 308

See application file for complete search history.

(56) References Cited

U.S. PATENT DOCUMENTS

| | | | | | |
|---|---|---|---|---|---|
| 3,369,360 | A | * | 2/1968 | De Biasi | 60/396 |
| 3,401,764 | A | * | 9/1968 | Schafer | 180/305 |
| 3,633,700 | A | * | 1/1972 | Matthews et al. | 60/438 |
| 3,656,570 | A | * | 4/1972 | Gortnar et al. | 180/6.48 |
| 3,780,819 | A | * | 12/1973 | Coordes | 180/14.2 |
| 3,804,190 | A | * | 4/1974 | Shaffer | 180/253 |
| 3,865,207 | A | * | 2/1975 | Schwab et al. | 180/253 |
| 3,869,107 | A | | 3/1975 | Field et al. | 251/94 |
| 4,099,588 | A | * | 7/1978 | Dezelan | 180/242 |
| 4,116,294 | A | * | 9/1978 | Johnston | 180/242 |
| 4,554,992 | A | * | 11/1985 | Kassai | 180/307 |
| 4,949,805 | A | | 8/1990 | Mather et al. | 180/333 |
| 5,137,100 | A | * | 8/1992 | Scott et al. | 180/6.48 |
| 5,181,579 | A | * | 1/1993 | Gilliem | 180/6.48 |

(Continued)

FOREIGN PATENT DOCUMENTS

DE 0 086 332 8/1983

(Continued)

OTHER PUBLICATIONS

PCT Search Report PCT/US2008/011060 dated Sep. 24, 2008.

*Primary Examiner* — John R Olszewski
(74) *Attorney, Agent, or Firm* — John D. Veldhuis-Kroeze; Westman, Champlin & Kelly, P.A.

(57) ABSTRACT

A vehicle having an auxiliary power system for supplying power to an implement is disclosed. The power system includes a power enablement device having an enablement component that allows or prevents supplying power to the implement, and an auxiliary actuator operably coupled to the power enablement device. The auxiliary actuator can be manipulated between a first, de-actuated position and a second, actuated position. An operator actuable continuous actuation device is moveable between engaged and disengaged positions, providing an actuation signal indicative of its position. A continuous enablement actuator is capable of engaging the enablement component when the enablement component is in the actuated position to discourage the enablement component from moving to the de-actuated position. The continuous enablement actuator engages the enablement component when the actuation signal indicates one of the engaged and disengaged positions and is disengaged from the enablement component when the actuation signal indicates the other position.

3 Claims, 15 Drawing Sheets

U.S. PATENT DOCUMENTS

| | | | | |
|---|---|---|---|---|
| 5,348,115 | A * | 9/1994 | Devier et al. | 180/308 |
| 5,397,890 | A | 3/1995 | Schueler et al. | 250/221 |
| 5,425,431 | A * | 6/1995 | Brandt et al. | 180/273 |
| 5,509,258 | A | 4/1996 | Thier et al. | 56/11.3 |
| 5,711,391 | A * | 1/1998 | Brandt et al. | 180/273 |
| 5,931,254 | A * | 8/1999 | Loraas et al. | 180/272 |
| 6,056,074 | A | 5/2000 | Heal et al. | 180/6.48 |
| 6,460,640 | B1 | 10/2002 | Keagle et al. | 180/19.3 |
| 6,935,446 | B2 | 8/2005 | Walker | 180/6.48 |
| 6,948,398 | B2 | 9/2005 | Dybro | 74/471 |
| 7,059,434 | B2 | 6/2006 | Bares | 108/6.48 |
| 7,228,679 | B2 | 6/2007 | Berkeley | 56/10.2 |
| 7,240,756 | B2 | 7/2007 | Derby | 180/19.3 |
| 2003/0015367 | A1 * | 1/2003 | Miller | 180/308 |
| 2003/0149518 | A1 * | 8/2003 | Brandt et al. | 701/50 |
| 2004/0145134 | A1 | 7/2004 | Bares | 280/32.7 |
| 2007/0062075 | A1 * | 3/2007 | Graham et al. | 37/234 |

FOREIGN PATENT DOCUMENTS

| | | |
|---|---|---|
| EP | 0 751 302 | 2/1997 |

* cited by examiner

AUXILIARY HYDRAULIC FLOW CONTROL SYSTEM FOR A SMALL LOADER

CROSS REFERENCE TO RELATED APPLICATIONS

This application is related to and claims priority from U.S. Provisional Patent Application 60/974,519, which was filed on Sep. 24, 2007 and is entitled "Vehicle Including an Interlock System, Industrial Equipment Including an Interlock System, and a Method of Controlling an Auxiliary System".

BACKGROUND

The present discussion is related to a vehicle, such as a walk behind loader, or industrial equipment having a drive system and an auxiliary system. The present discussion is more particularly related to a method of enabling an auxiliary system on the vehicle.

Vehicles such as loaders are useful for performing a variety of tasks in industrial, agricultural, commercial and other applications and environments. Loaders come in a variety of configurations and sizes, including, for example, walk-behind loaders, which are operable from the rear of the loader by an operator that can walk behind the loader. Such loaders can also include a platform on which an operator can ride. In such instances, an operator rides along with the loader instead of walking behind the loader.

Loaders often include hydraulic systems, which are coupled to an engine and provide power that can be utilized to perform a number of tasks, such as propelling the machine and providing power to perform loader functions, such as raising and lowering lift arms. In addition, some loaders provide hydraulic power sources that can be utilized by attachments, implements or accessories (collectively, for the purposes of this discussion, "implements") that are coupled to the loader. The hydraulic power source provided for use by implements is generally known as an auxiliary power source.

SUMMARY

In one illustrative embodiment, a vehicle having an engine, a drive system operably coupled to the engine, and an auxiliary power system operably coupled to the engine for supplying a power source to an implement during an active state and refraining from supplying the power source to the implement during an inactive state. The drive system causes the vehicle to move relative to a support surface and includes a drive handle operable by an operator for providing a signal indicative of a desired direction of travel.

The auxiliary power system includes an auxiliary power enablement device, an auxiliary actuator, an operator actuable continuous actuation device, and a continuous enablement actuator. The auxiliary power enablement device is moveable between an actuated position and a de-actuated position. In the actuated position, the auxiliary power enablement device enables the power source to be supplied to the implement. In the de-actuated position, the auxiliary power enablement device prevents the auxiliary power from being supplied to the implement.

The auxiliary actuator is operably coupled to the auxiliary power enablement device and is capable of being manipulated by an operator between a first position and a second position. The first position corresponds to the de-actuated position of the auxiliary power enablement device and the second position corresponds to the actuated position of the auxiliary power enablement device. The operator actuable continuous actuation device is movable between an engaged position and a disengaged position. It provides an actuation signal indicative of the position of the operator actuable continuous actuation device.

The continuous enablement actuator is capable of engaging the power enablement device when the power enablement device is in the actuated position to prevent the power enablement device from moving to the de-actuated position while the continuous enablement actuator is engaging the power enablement device. The continuous enablement actuator is configured to engage the power enablement device when the actuation signal is indicative of one of the engaged position and the disengaged position and is configured to attempt to be disengaged from the power enablement device with the actuation signal is indicative of the other of the engaged position and the disengaged position.

In another embodiment, a method of providing a power source to an implement from a vehicle having an engine, a drive system operably coupled to the engine, and a power control system for providing the power source is discussed. The power control system includes a power enablement device moveable between an actuated position and a de-actuated position for selectively providing the power source to the implement. The method includes receiving an operator signal from a sensing mechanism indicative of the position of an operator actuable continuous actuation device and providing an enablement signal to a continuous enablement actuator. The operator actuable continuous actuation device has an engaged position and a disengaged position. The operator actuable continuous actuation device is biased toward the disengaged position.

Providing the enablement signal to a continuous enablement actuator includes providing a signal indicative of urging the continuous enablement actuator to attempt one of engaging the power enablement device and disengaging the power enablement device. Engaging the power enablement device with the continuous enablement actuator prevents the power enablement device from moving to the de-actuated position. Dis-engaging the continuous enablement actuator from the power enablement device allows the power enablement device to move to the de-actuated position. The signal indicative of engaging the power enablement device is provided when the operator signal received is indicative of one of the engaged position and the disengaged position, but not the other of the engaged position and the disengaged position.

In yet another embodiment a hydraulic system for a loader configured to provide hydraulic fluid to an implement attached to the loader is discussed. The hydraulic system includes a valve, an actuator, an enabling member and a continuous engagement member. The valve has a de-actuated position, which blocks hydraulic fluid from being supplied to the implement and actuated position, which allows hydraulic fluid to be supplied to the implement. The valve has a bias toward the de-actuated position. The actuator is operably coupled to the valve and is capable of being manipulated by an operator to overcome the bias and cause the valve to move from the de-actuated position to the actuated position.

The enabling member is moveable between an engaged position and a disengaged position and provides an enablement signal indicative of its position. The continuous engagement member is capable of engaging the valve when the valve is the actuated position to cause the valve to remain in the actuated position while the continuous engagement member is engaged with the valve. The continuous engagement member is configured to attempt to engage the valve when the enablement signal is indicative of one of the engaged position and the disengaged position and disengage from the valve when the enablement signal is indicative of the other of the engaged position and the disengaged position.

DETAILED DESCRIPTION

The embodiments that are discussed herein are illustrative in nature and are not intended to limit the scope of any claimed subject matter. As such, their discussion does not limit the scope of claimed subject matter to any particular details of construction and the arrangement of components set forth in the following description or illustrated in the following drawings.

Also, it is to be understood that the terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
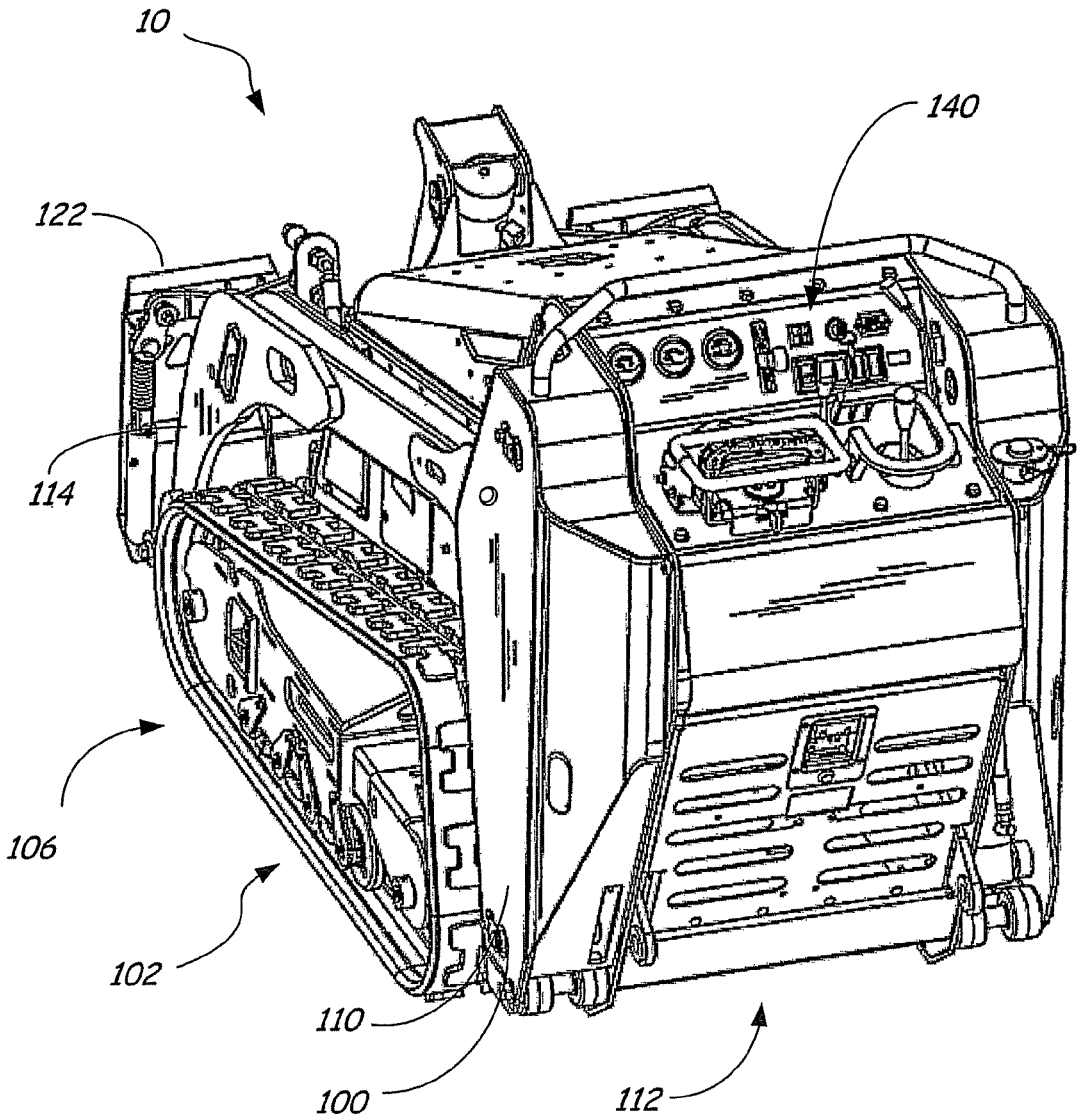
FIG. 1 is a perspective view generally taken from a rear of a walk behind loader of the type where incorporation of the embodiments discussed herein can be useful.
Figure 2:
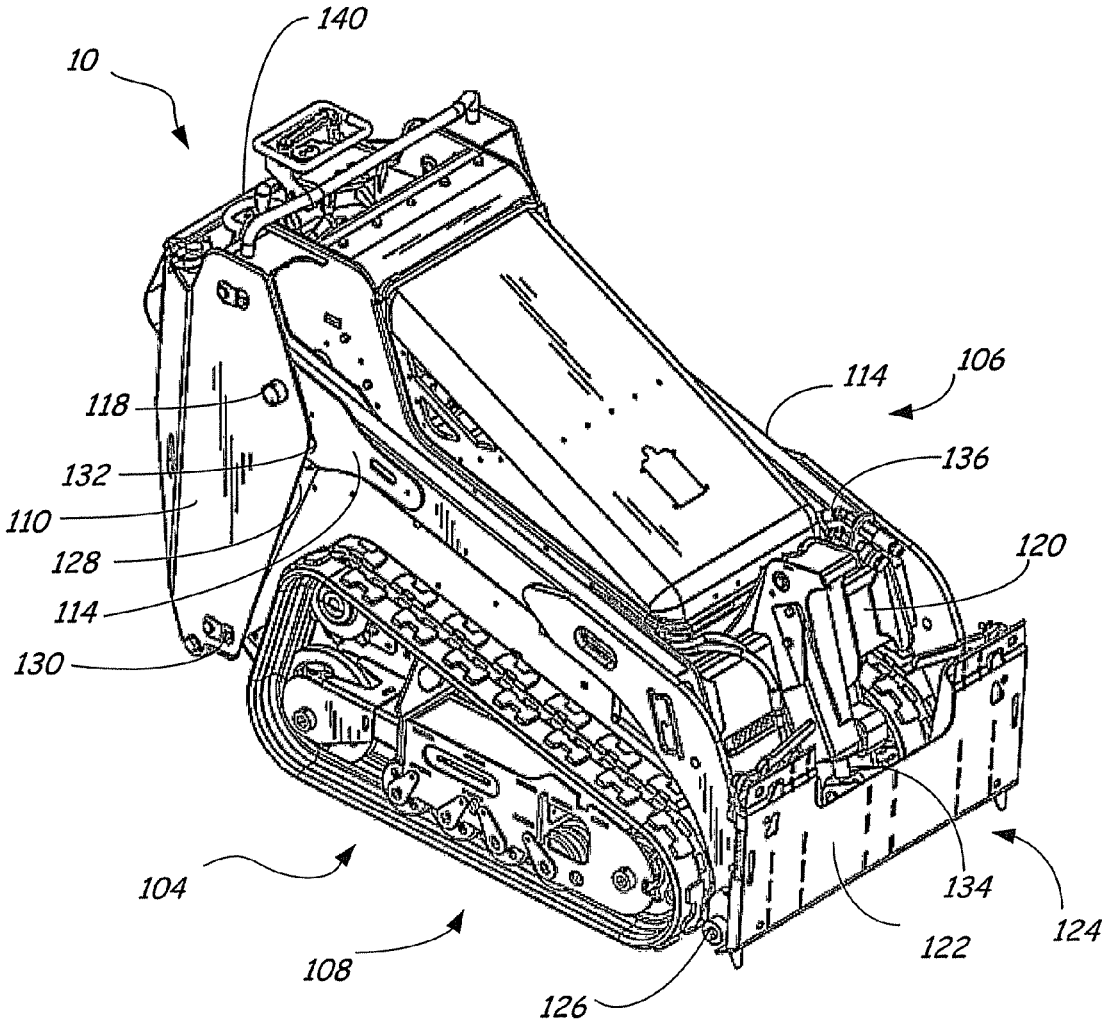
FIG. 2 is another perspective view of the walk behind loader illustrated in FIG. 1 generally taken from a front of the loader.
Figure 3:
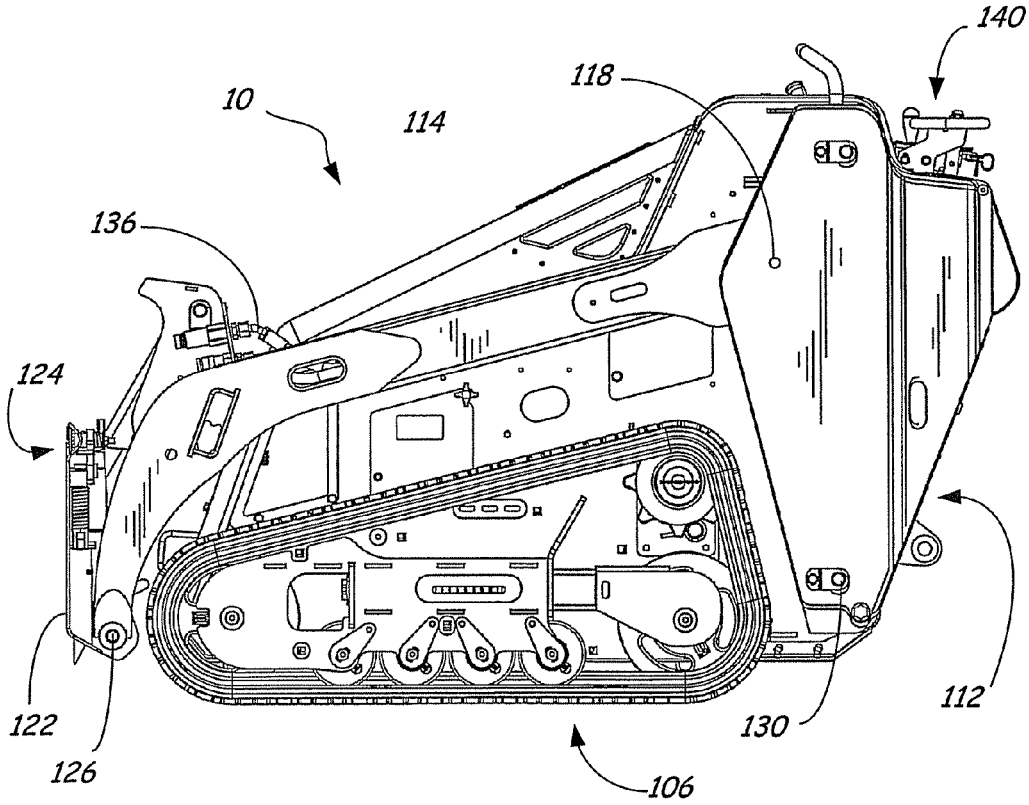
FIG. 3 is a side elevation view of the walk behind loader illustrated in FIG. 1.

FIGS. 1-3 illustrate a small self propelled, walk behind loader 10 of the type for which a continuous flow engagement system is advantageous. The loader is shown with a loader frame 100 and a pair of track drive systems 102 and 104 that are illustratively bolted onto the loader frame 100 on a first side 106 and a second side 108 of the loader frame 100, respectively. The loader 10 can include a ride-on platform not shown in any of FIGS. 1-3, but as shown in, for example, U.S. Patent Application Publication No. 2004/0145134 A1, published on Jul. 29, 2004, which is hereby incorporated by reference. The loader 10 shown in the figures and described herein is one example of a vehicle upon which the embodiments discussed herein can be incorporated. It should be appreciated that such the embodiments can alternatively be incorporated with other vehicles, such as those commonly employed in lawn and garden applications, to give one example, without departing from the scope of the discussion herein. In general, vehicles that incorporate the discussed embodiments are intended to include various self propelled arrangements. Furthermore, such vehicles may have tracks, rigid or steerable wheeled axles, as well as other drive and/or steering arrangements. In addition, such vehicles need not provide a means for carrying the operator.

The frame 100 of loader 10 illustratively includes a pair of vertically extending upright support structures 110, disposed on the first side 106 and second side 108 near a distal end 112 of the loader 10. The vertically extending upright support structures 110 support lift arms 114, each of which are pivotally coupled at a distal end 112 thereof to one the upright support structures 110 at pivot points 118. The lift arms 114 are illustratively coupled together via a crossmember 120, which is positioned between, and attached to, the lift arms 114. The lift arms 114 support an implement interface structure 122 that is pivotally attached to a proximal end 124 of each of the lift arms 114 at pivot points 126. The implement interface structure 122 is capable of receiving any of a number of implements (not shown in FIGS. 1-3), which can be used in conjunction with loader 10 to perform various tasks.

As discussed above, the lift arms 114 are pivotally coupled to the upright support structures 110 at pivot points 118. In addition, an actuator 128 (only one of which is shown) is coupled to each of the upright support structures 110 and lift arms 114 at connection points 130 and 132. In one illustrative embodiment, the actuators 128 are hydraulic cylinders, which are capable of being actuated so that they extend and retract to cause the lift arms 114 to rotate about the pivot points 118 in a generally arcuate path. Alternatively, the actuators 128, lift arms 114, and upright support structures 110 can be configured to cause the lift arms 114 to raise and lower in paths other than a generally arcuate path when the actuators 128 are actuated, such as, for example, a generally vertical path.

Similar to the connection between the lift arms 114 and the upright support structures 110, the implement interface structure 122 is pivotally attached to the lift arms 114. In addition, an actuator 134, such as a hydraulic cylinder, is coupled to each of the crossmember 120 and the implement interface structure 122. When the actuator 134 is actuated, the implement interface structure 122 is capable of pivoting about pivot points 126 in a generally arcuate path with respect to the lift arms 114. While FIG. 2 illustrates a single actuator 134, it should be appreciated that multiple actuators may be incorporated to cause the implement interface structure 122 to pivot with respect to the lift arms 114.

As discussed above, the implement interface structure 122 is capable of receiving and being coupled to a number of different types of implements. The cooperation of an implement with loader 10 allows an operator to manipulate the combination of the loader 10 and the implement to perform various tasks. As an example, one type of implement is a bucket (not shown in any of the Figures). A bucket is a relatively simple implement that can be utilized to dig and/or carry material. By manipulating the drive systems 102 and/or 104, the lift arms 114 and the implement interface structure 122, an operator can, for example, move the bucket to cause material to be loaded into the bucket, move the loader 10 to another location, and dump the material out of the bucket.

Some implements are more complex than the simple bucket described above. By "complex", it is to be understood that such implements are capable of performing functions by converting a power source illustratively provided by the loader 10 to control a working device on the implement. To that end, loader 10 also illustratively includes an auxiliary hydraulics power system (not shown in FIGS. 1-3, but shown in FIG. 7 as block 138 and discussed below in the text accompanying FIG. 7), which provides a hydraulic power source capable of being accessed by an implement. The auxiliary hydraulics power system 138 includes port 136, which illustratively include tubing, hoses, hydraulic fittings, or the combination thereof that are configured to be coupled to hydraulic components on an implement so that pressurized hydraulic fluid from the loader 10 is accessible by an implement.

One example of such a complex implement is a mower (not shown in any of the figures). A mower typically includes a blade that is rotatably coupled to a mower frame (i.e. a working device) along a generally vertical axis with respect to the mower frame and a device such as a hydraulic motor coupled to the blade. When hydraulic fluid from the auxiliary hydraulics power system 138 flows through the hydraulic motor, the motor is capable of rotating the blade about the axis. When properly positioned, the blade is capable of mowing grass or other similar vegetation. It should be appreciated that many other types of implements can be coupled to loader 10 and that the mower discussed herein is but one example. Other examples include, but are not limited to, augers and tillers.

Figure 4:
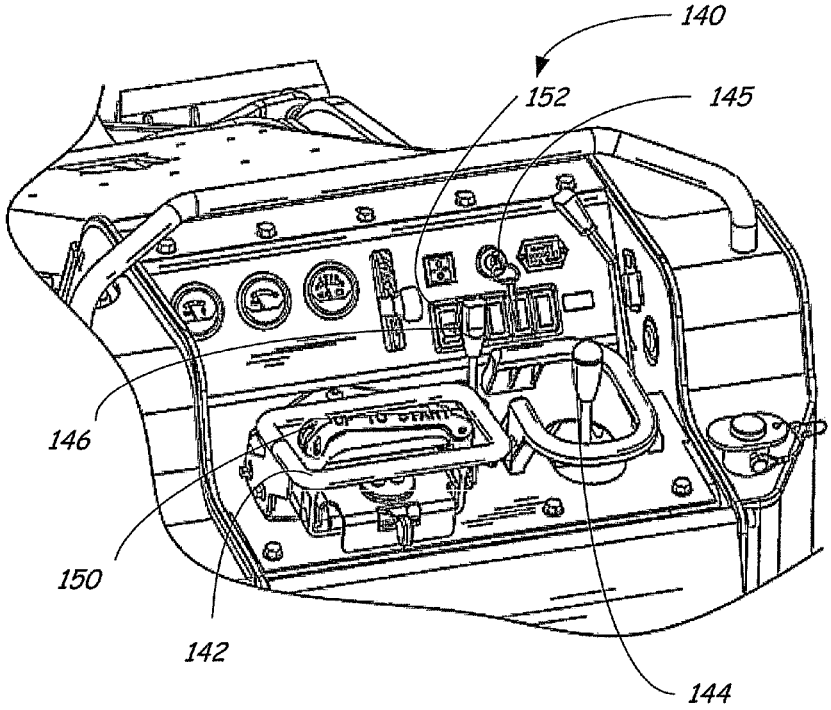
FIG. 4 is a schematic illustration of a control panel located in a rearward portion of the loader of FIG. 1 including devices capable of being manipulated by an operator to control various loader related functions according to one illustrative embodiment.

The drive and loader functions as well as operation of a working device on any implement that may be attached to loader 10 are controllable by the operator. To that end, loader 10 also includes, as illustrated in FIGS. 1 and 4, a control panel 140 located near the distal end 112 of loader 10 between the upright support structures 110 so that it is accessible by an operator positioned in the proper operating position immediately behind the distal end 112 of the loader 10. The control panel 140 includes a number of operator control devices that are capable of being manipulated by the operator to control the various machine functions. For example, a drive handle 142 is located in the control panel 140 and is capable of being manipulated to provide one or more signals indicative of whether the operator intends to have the loader 10 move in a particular direction and at a given rate. Signals from the drive handle 142 are provided to a drive control system (not shown in FIGS. 1-4, but discussed in more detail below), which controls movement of the drive systems 102 and 104.

In addition, the control panel 140 includes a loader control input device 144. The loader control input device 144 is configured to be manipulated by an operator to provide signals indicative of a desired control of the movement of the lift arms 114 and the implement interface structure 122. In one illustrative embodiment, the loader control input device 144 is a two-axis joystick. Movement along one of the axes provides a signal indicative of desired movement of the lift arms 114. Movement along the other of the axes provides a signal indicative of desired movement of the implement interface structure 122. Signals from the loader control input device are provided to a loader control system (not shown in FIGS. 1-4, but discussed in more detail below) for controlling the actuators 128 and 134.

The control panel 140 also illustratively includes an auxiliary function input device 146. The auxiliary function input device 146 is, in one embodiment, a lever that is capable of being manipulated by an operator. The auxiliary function input device or lever 146 provides a signal indicative of a desired control of the auxiliary hydraulics power system 138 based on the position of the auxiliary function input device 146. The signal provided by the auxiliary function input device 146 may be a hydraulic signal, an electric signal, a mechanical signal or any other type of signal capable of conveying the position of auxiliary function input device 146. In one embodiment, the auxiliary function input device 146 is moveable along an axis and is biased toward a center position. When the auxiliary function input device 146 is positioned in the center position, a signal is provided that is indicative of a neutral condition. In a neutral condition, it is intended that the auxiliary hydraulics power system 138 provide no hydraulics fluid to any implement.

If the auxiliary function input device 146 is not in the center position, it is intended that hydraulic fluid is provided to any implement attached to the auxiliary hydraulics power system 138 in one of two directions. For example, if an operator applies a force to the auxiliary function input device 146 to move it in a first direction, the auxiliary function input device 146 provides a signal indicative of the operator's intention to provide hydraulic fluid to an implement in a first direction. Similarly, if an operator applies a force to the auxiliary function input device 146 to move it in a second direction, the auxiliary function input device 146 provides a signal indicative of the operator's intention to provide hydraulic fluid to an implement in a second direction. Because the lever 146 is biased to the center position, unless a force is applied to the lever 146, the lever 148 is inclined to return to the center position without operator intervention. Thus, a signal indicative of a condition where no hydraulic fluid is enabled to flow to an implement is sent to the auxiliary hydraulics power system 138. It should be appreciated that any acceptable force can be provided to bias the lever 148 in the center position including spring mechanisms integral to, or remote from, the auxiliary function input device 146. As will be discussed in more detail below, however, it can be advantageous to allow for continuous hydraulic fluid flow to an implement without requiring that an operator continuously applying a force to manipulate lever 148.

The control panel 140 also illustratively includes an operator actuable continuous flow engagement device 150 and an auxiliary hydraulic mode switch 152. The continuous flow engagement device 150, in illustrative embodiment, is an operator actuable continuous actuation device such as a lever that is pivotally attached to the drive handle 142. As will be described in more detail below, the continuous flow engagement device 150 is biased in one position so that a force need be applied to the continuous flow engagement device 150 to cause the continuous flow engagement device 150 to pivot from an unactuated position into an actuated position. A sensing mechanism (not shown, but discussed in more detail below) is, in one embodiment, positioned in close proximity to the continuous flow engagement device 150 and is configured to provide a signal indicative of when continuous flow engagement device 150 is in an actuated or unactuated position.

The auxiliary hydraulic mode switch 152 is illustratively a two-position switch that an operator can manipulate to cause the loader 10 to control the function of the auxiliary hydraulics power system 138 in one of two modes, depending on the position of the switch. In some embodiments, the control panel 140 does not include an auxiliary hydraulic mode switch 152, thereby eliminating one of the two modes of operation of the auxiliary hydraulics power system 138. The operation of the auxiliary hydraulic mode switch 152 and the two possible modes of operation for the auxiliary hydraulics power system 138 will be discussed in more detail below.

The control panel 140 also illustratively includes a keyswitch 145. The keyswitch 145, in one illustrative embodiment, has at least three positions, including an off position, a run position, and a start position. In the off position, the engine (202 in FIG. 7) is provided a signal or an absence of a signal, which is intended to turn off the engine. In the run position, the engine is provided a signal that is indicative of allowing the engine to run if it has been started. In the start position, a signal is provided that, if received by a starter (201 in FIG. 7), causes the starter to engage the engine and cause engine to start running. Providing such a signal to the starter will be discussed in more detail below.

Figure 5:
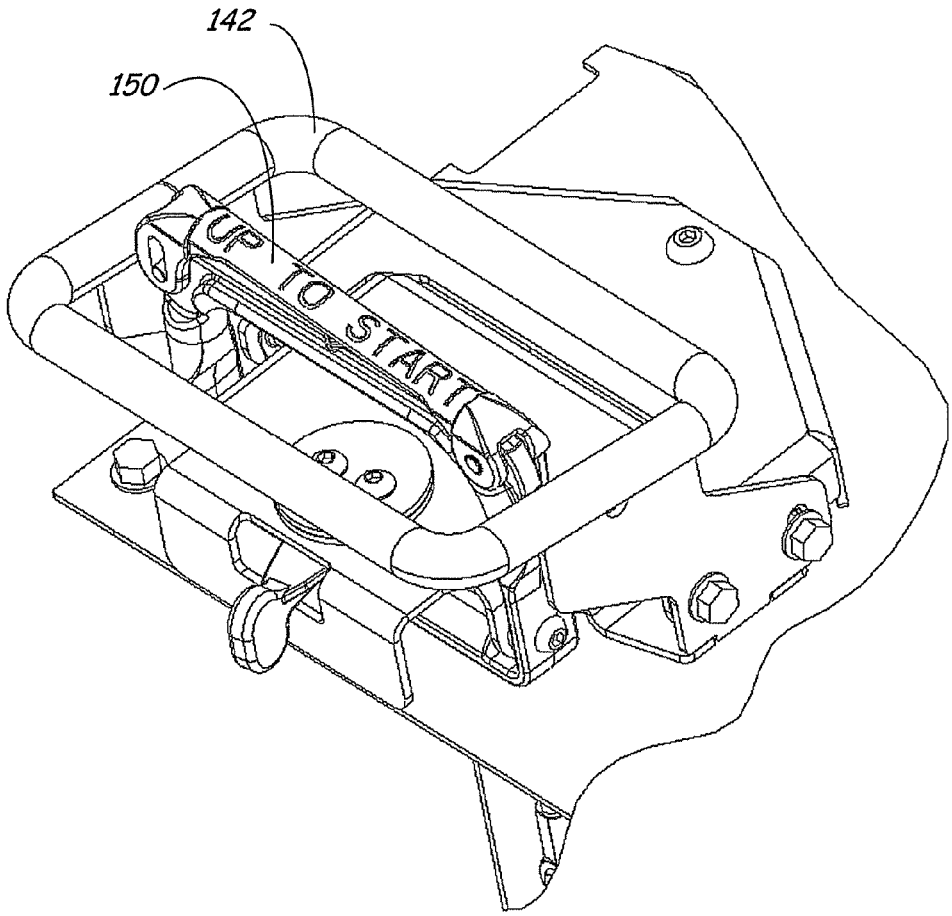
FIG. 5 is a perspective view of a drive handle for the walk behind loader that is illustratively located on the control panel of FIG. 4.
Figure 6:
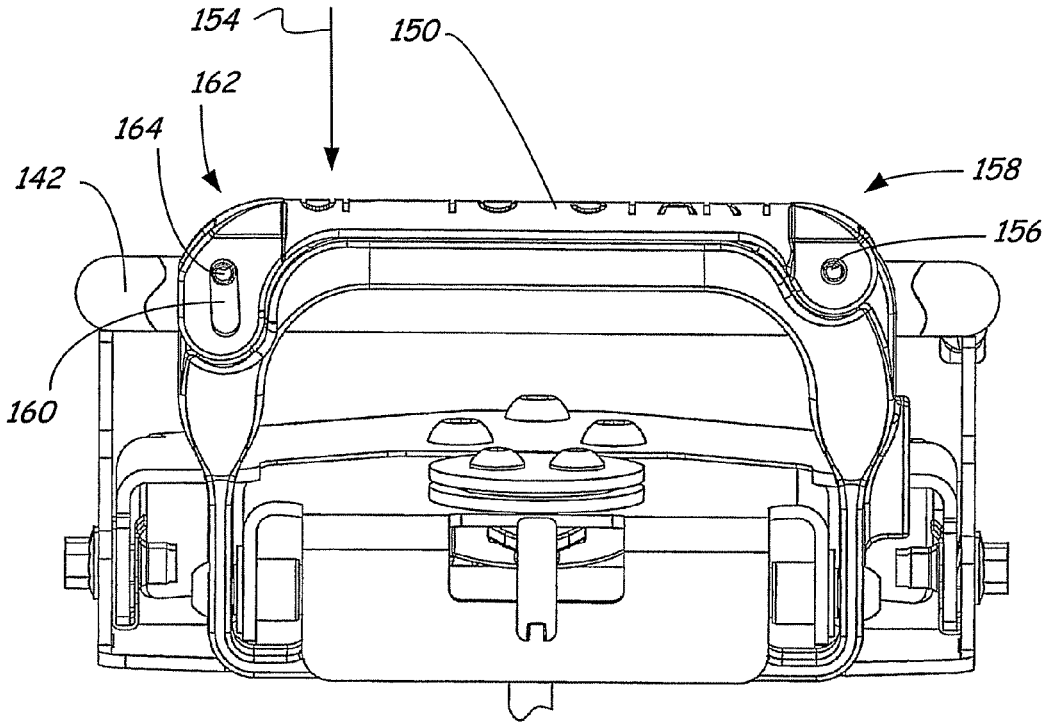
FIG. 6 is a rear elevation view of the drive handle of FIG. 5 showing a continuous flow engagement device in an engaged position.
Figure 6A:
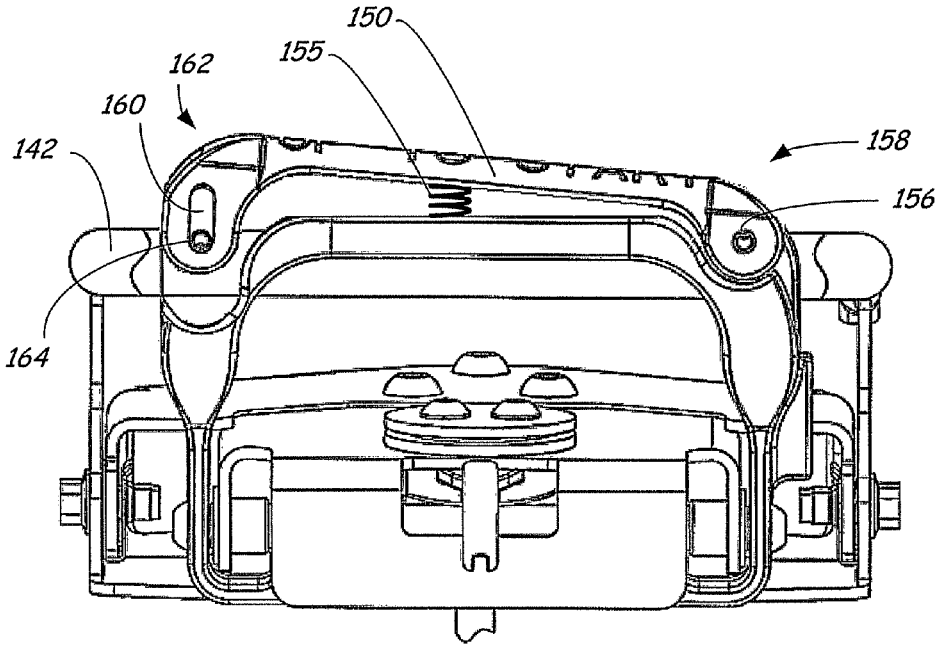
FIG. 6A is a rear elevation view of the drive handle of FIG. 5 showing the continuous flow engagement device in a disengaged position.

The drive handle 142 is illustrated in more detail in FIGS. 5, 6 and 6A, showing features of the continuous flow engagement device 150. The continuous flow engagement device 150 is pivotally attached to the drive handle 142 at pivot 156 at a first end 158 of the continuous flow engagement device 150. The continuous flow engagement device 150 has slots 160 on a second end 162 that are advantageously positioned to engage protrusions 164 on the drive handle 142. The engagement between the protrusions 164 and the slots 160 effectively limit the rotational movement of the continuous flow engagement device 150 about pivot 156. A spring 155 positioned between the continuous flow engagement device 150 and the drive handle 142 biases the lever away from the drive handle 142. The continuous flow engagement device 150 and/or the drive handle 142 are advantageously formed, at least in part, from materials that provide cushioned feel for an operator when grasping the drive handle 142 and continuous flow engagement device 150.

In one embodiment, a sensing mechanism (not shown) is positioned proximal to continuous flow engagement device 150 for sensing the position of the continuous flow engagement device 150 with respect to the drive handle 142. The sensing mechanism is, in one embodiment, a switch or other suitable device capable of providing a signal indicative of the position of the continuous flow engagement device 150. The signal may be provided via electrical wires, wireless signals, or any other type of signal to a control device. The sensing mechanism provides an output signal indicative of one of two distinct positions of continuous flow engagement device 150, which, as discussed above, can be described as a disengaged position and an engaged position. Alternatively, the sensing mechanism may be sensitive to contact with, for example, an operator's hand. In such an embodiment, the continuous flow engagement device may simply be a handle that the operator can grab rather than one that requires an operator to manipulate the device from one position to another. In such embodiments, mere touch of the continuous flow engagement device causes the sensing mechanism to sense the engaged position.

In the disengaged position, the force from the spring 155 biases the continuous flow engagement device 150 away from the drive handle 142, as is illustrated in FIG. 6A. Unless a force is applied to the continuous flow engagement device 150. In the engaged position, a force, such as may be applied by an operator's hand, is applied in a direction illustrated by arrow 154 to overcome the bias of the spring 155 and cause the continuous flow engagement device 150 to be rotated in close proximity to, if not in actual contact with, the drive handle 142. The sensing mechanism is then configured to provide a signal indicative of the engaged position. Because the continuous flow engagement device 150 requires a constant force to be applied to the continuous flow engagement device 150 before the sensing mechanism provides the engaged signal, the continuous flow engagement device 150 effectively provides an indication of whether an operator is properly positioned in close proximity to the control panel 140. How the signals provided by the sensing mechanism are processed to affect the functionality of the auxiliary hydraulics power system 138 will be discussed in more detail below.

Figure 7:
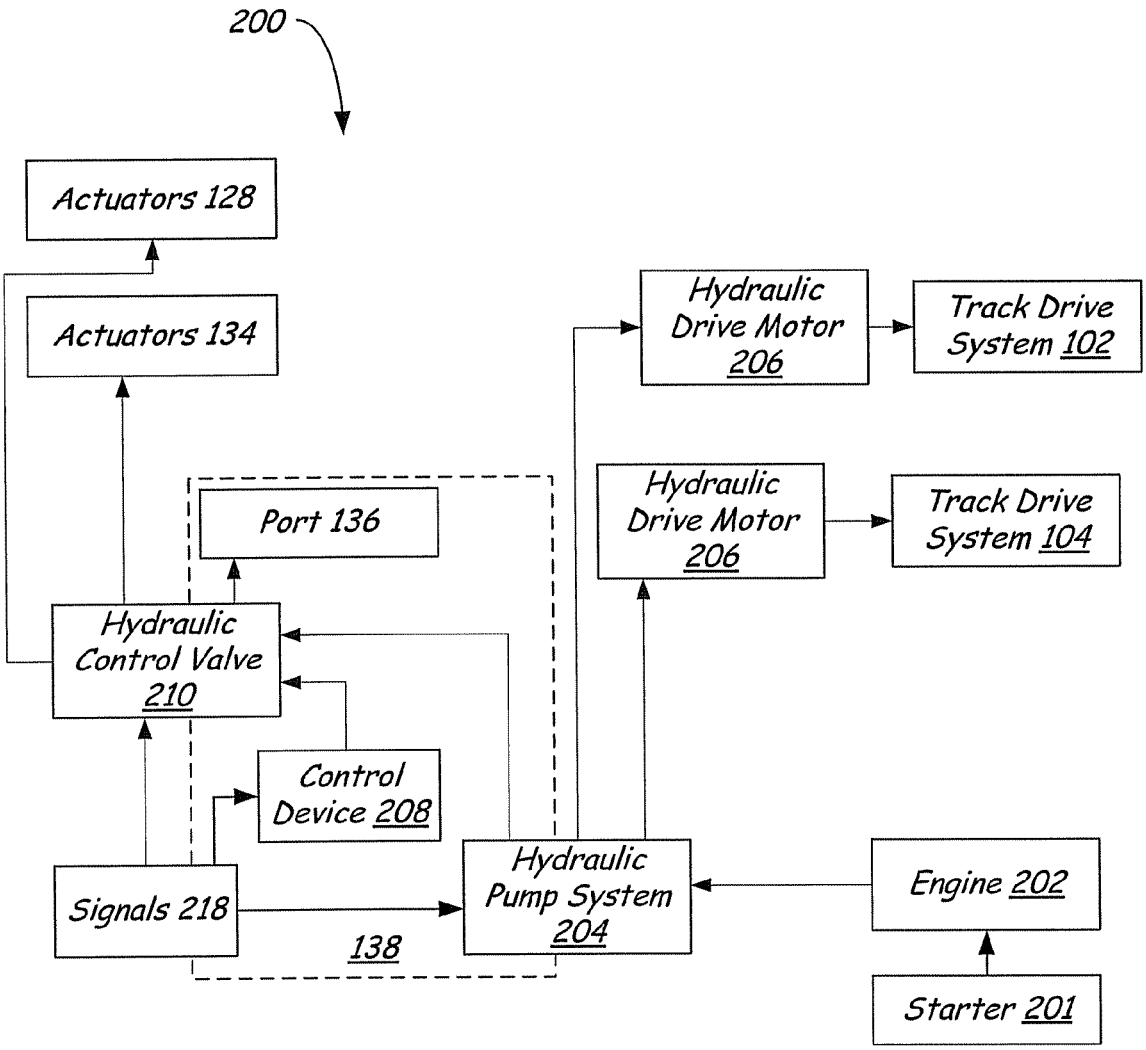
FIG. 7 is a schematic block diagram illustrating a power control system for controlling hydraulic functions on the loader of FIG. 1 according to one illustrative embodiment.

As discussed above, loader 10 includes a hydraulic system that provides a power source and control of the auxiliary hydraulics power system 138. FIG. 7 is a block diagram that schematically illustrates such a power control system 200 for loader 10, which includes hydraulic components that are part of auxiliary hydraulics power system 138. Auxiliary hydraulics power system 138 is shown as a dashed line in FIG. 7 for clarity purposes. It should be appreciated that some of the components included in hydraulics power system 138, in some embodiments, provide capabilities for the loader 10 that are in addition to the capabilities as part of the hydraulic power system 138 and this is illustrated in FIG. 7.

The power control system 200 includes an engine 202 and a hydraulic pump system 204, which is coupled to an output shaft of the engine 202. The engine 202 provides power to the hydraulic pump system 204, which in turn converts the input power received from the engine 202 into hydraulic power. A starter 201 provides a signal to the engine 202 to start the engine, based on inputs provided by a user, as will be discussed in more detail below. In one illustrative embodiment, the hydraulic pump system 204 includes one or more hydrostatic pumps that provide hydraulic power in the form of hydraulic fluid under pressure to a pair of hydraulic drive motors 206, which are in turn coupled to track drive systems 102 and 104. While the hydraulic pump system 204 is shown as a single block in FIG. 7, it should be appreciated that the hydraulic pump system 204 can include any number of hydraulic pumps. For example, separate hydrostatic pumps are advantageously implemented so as to be coupled to each of the hydraulic drive motors 206. It should be further appreciated, of course, that other types of drive systems besides track drive systems can be incorporated into loader 10, as described above. Furthermore, although each of the track drive systems 102 and 104 are shown as being coupled to a separate drive motor 206, it should be appreciated that a single drive motor can, in some embodiments, be coupled to more than one drive system. For example, a single drive motor can be coupled to two-wheeled drive systems on the same side of a loader. Other drive arrangements are also contemplated.

The hydraulic pump system 204 also illustratively includes a hydraulic pump that provides an output to a hydraulic control valve 210. Hydraulic control valve 210 illustratively provides hydraulic outputs to actuators 128, actuator 134, as well as a hydraulic output to port 136, which is part of the auxiliary hydraulics power system 138. The hydraulic control valve 210, in one embodiment, is a collection of spool valves, each of which controls the flow of hydraulic fluid to their respective load, the load being one of the actuators 128, actuator 134, and an attached implement to the port 136. It should be appreciated that while the hydraulic control valve 210 includes, in one embodiment, a single valve body with a plurality of spool valves located therein, alternatively, hydraulic control valve 210 can include a plurality of valve bodies with spool valve or other types of valve configurations that are configured to provide hydraulic fluid to the actuators listed above. In the illustrative embodiment, each of the spool valves has a neutral position, in which hydraulic fluid is not provided to its designated load. Manipulation of one of the spool valves from the neutral position will cause flow of hydraulic fluid in one of two directions. Operation of the hydraulic control valve 210, particularly as it pertains to the control of hydraulic fluid to the port 136 of auxiliary hydraulics power system 138, will be discussed in more detail below.

As discussed above, the control panel 140 includes a plurality of operator controls, which are configured to provide input signals indicative of a desired control of one or more of the output functions of the hydraulic pump system 204 and the control valve 210. The signals are represented generally in FIG. 7 by input signals 218, which are shown as providing inputs to both the hydraulic pump system 204 and the control device 208. These signals will be discussed in more detail below. It should be appreciated that the input signals 218 are provided directly, or indirectly (such as via sensing mechanisms located proximal to one or more of the input devices), from devices including the drive handle 142, the auxiliary function input device 146, the continuous flow engagement device 150, and the auxiliary hydraulic mode switch 152 as well as other devices that may be incorporated into loader 10.

As discussed above, the hydraulic control valve 210 is illustratively connected to port 136 so that, under certain conditions, hydraulic fluid is proved to port 136 and thus made available to an implement attached to port 136. FIGS. 8A-D are diagrammatic illustrations of a cross-section of a spool valve 220, which is part of the hydraulic control valve 210 and is provided to provide a pathway for hydraulic fluid to flow to an attached implement through port 136. The spool valve 220 has a housing 222, which is capable of receiving a spool 224. The housing 222 has an inlet 226 to which the hydraulic pump system 204 is attached. The inlet 226 has a pair of ports 228 and 230. Hydraulic fluid is illustratively provided from the hydraulic pump system 204 to the spool valve 220 through duct 232 to port 228 as shown by arrow 234. Similarly, hydraulic fluid is returned from the spool valve 220 to the hydraulic pump system 204 via port 230 and through duct 236 as illustrated by arrow 238.

The spool valve 220 has an outlet 240, including ports 242 and 244, through which hydraulic fluid can be directed to an external device. Spool valve 220 is shown as being coupled to an implement 246 via ducts 135 and 137 to port 136, which includes coupling devices 139 and 141 to which the implement 246 is illustratively attached. For the purposes of this discussion, implement 246 can be any implement. One example, as discussed above, is a mower having a hydraulic motor that can be operated to rotate its blade. Of course, the implement 246 need not be a mower, but can be any of a number of different types of implements. It should be appreciated that a mower or other similar implements may have hydraulic circuitry that allows flow in only one direction through its motor. However, other implements, like a tiller, may allow flow in first and second directions such as is described in FIGS. 8B and 8C. Depending upon the position of the spool 224 with respect to the housing 222, the spool valve 220 either blocks the flow of hydraulic fluid or provides a path through the spool valve 220 to allow hydraulic fluid to travel to the implement 246 in one of two directions.

Figure 8A:
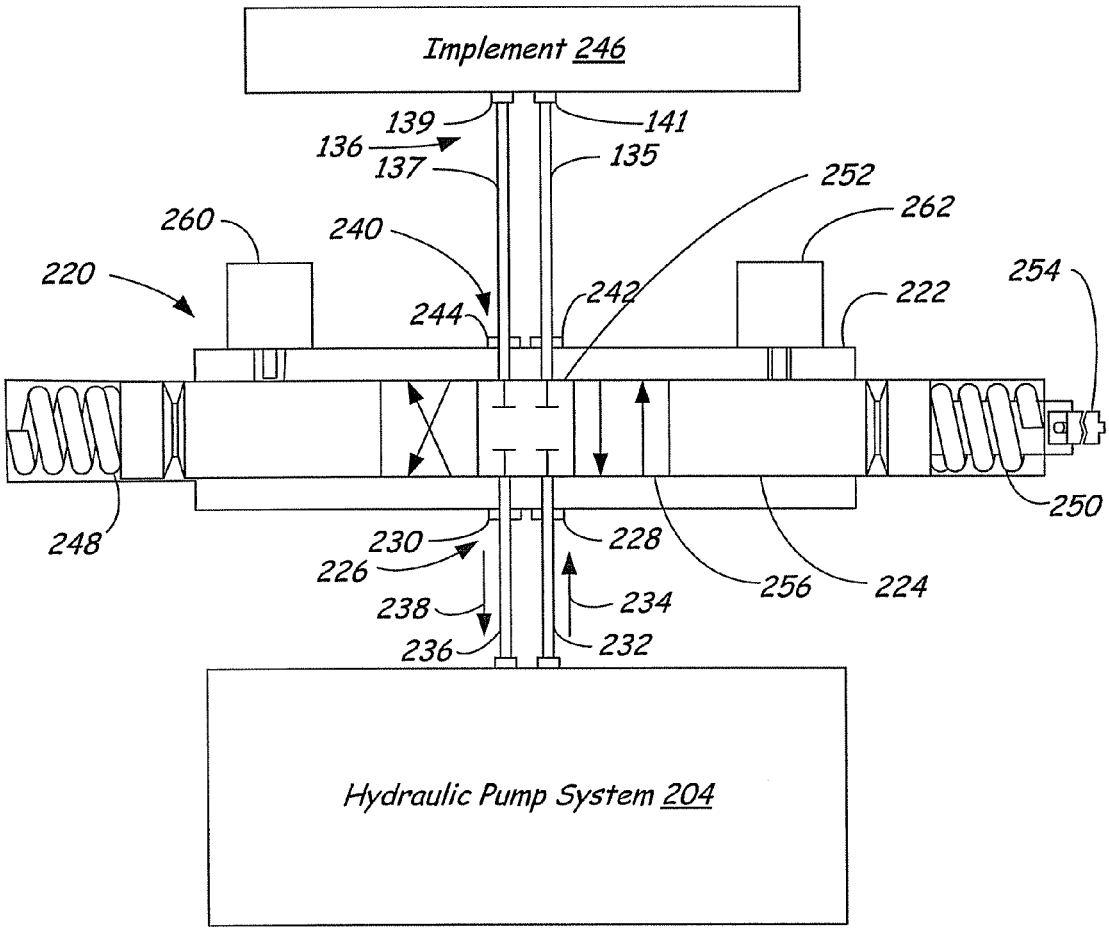
FIG. 8A is a schematic diagram of a control valve for use in the power control system of FIG. 7 illustrating a spool valve in a neutral position so as to prevent the flow of a fluid through the valve.

Spool 224 is engaged by a pair of springs 248 and 250, each of which positioned adjacent an end of the spool 224. When no outside force is applied to the spool the springs 248 and 250 are illustratively biased to urge the spool 224 to a neutral, or centered, position as is shown in FIG. 8A. When the spool 224 is in the centered position, hydraulic fluid provided by the hydraulic pump system 204 is not permitted to flow through to the implement 246. As is illustrated in FIG. 8A, symbol 252, which represents the blockage of hydraulic flow, is aligned with inlet 226 and outlet 240. Linkage 254 is illustratively attached to the spool 224. Although not shown in FIGS. 8A-8C, the linkage 254, in one embodiment, is operatively coupled to the auxiliary function input device 146 (shown in FIG. 4) and provides one of the input signals 218 discussed above with respect to FIG. 7. Manipulation of the auxiliary function input device 146 by an operator transfers a signal, which, in one embodiment, is a mechanical force, through the linkage 254 and onto the spool 224 corresponding to the manipulation by an operator. The signal provided by the linkage 254 cause the spool 224 to be shifted away from the centered position that is shown in FIG. 8A by overcoming one of the springs 248 and 250.

Figure 8B:
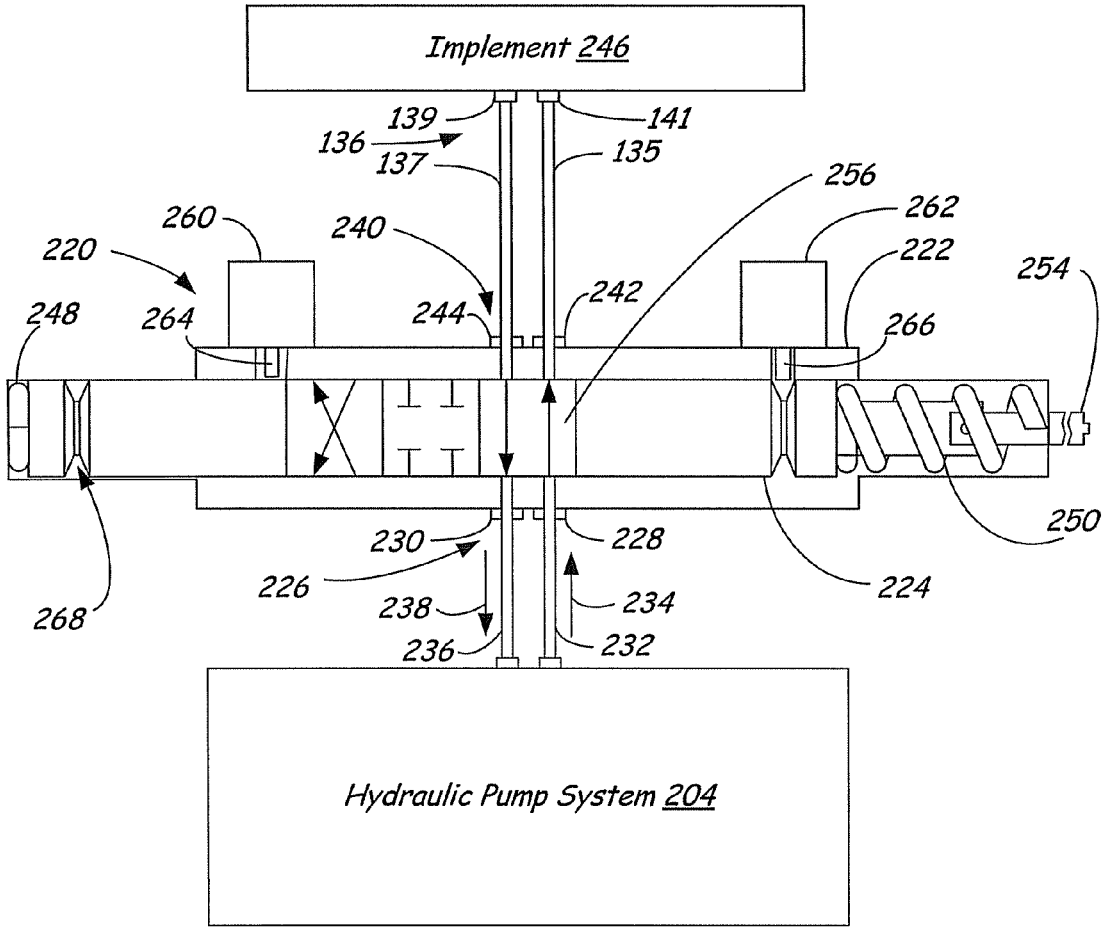
FIG. 8B is a schematic diagram of the control valve of FIG. 8A illustrating a spool valve in a first momentarily engaged position so as to allow the flow of a fluid through the valve.

In FIG. 8B, the linkage 254 applies a signal that causes the spool 224 to push against the spring 248, thereby causing the spring 248 to compress and shift the spool 224 away from the neutral position illustrated in FIG. 8A. This position, shown in FIG. 8B, provides a path to allow hydraulic fluid to pass from the hydraulic pump system 204 through the outlet 240 at port 242 to the implement 246. Likewise, hydraulic fluid is allowed to pass from the implement 246 through port 244 and back to the hydraulic pump system 204. The direction of flow in this position is illustrated by symbol 256, which also represents the position of the spool 224. When the spool 224 is positioned as shown in FIG. 8B, when hydraulic fluid is allowed to pass through the implement 246 in the direction illustrated by symbol 256, the fluid flow to the implement 246 is provided in a first direction.

Figure 8C:
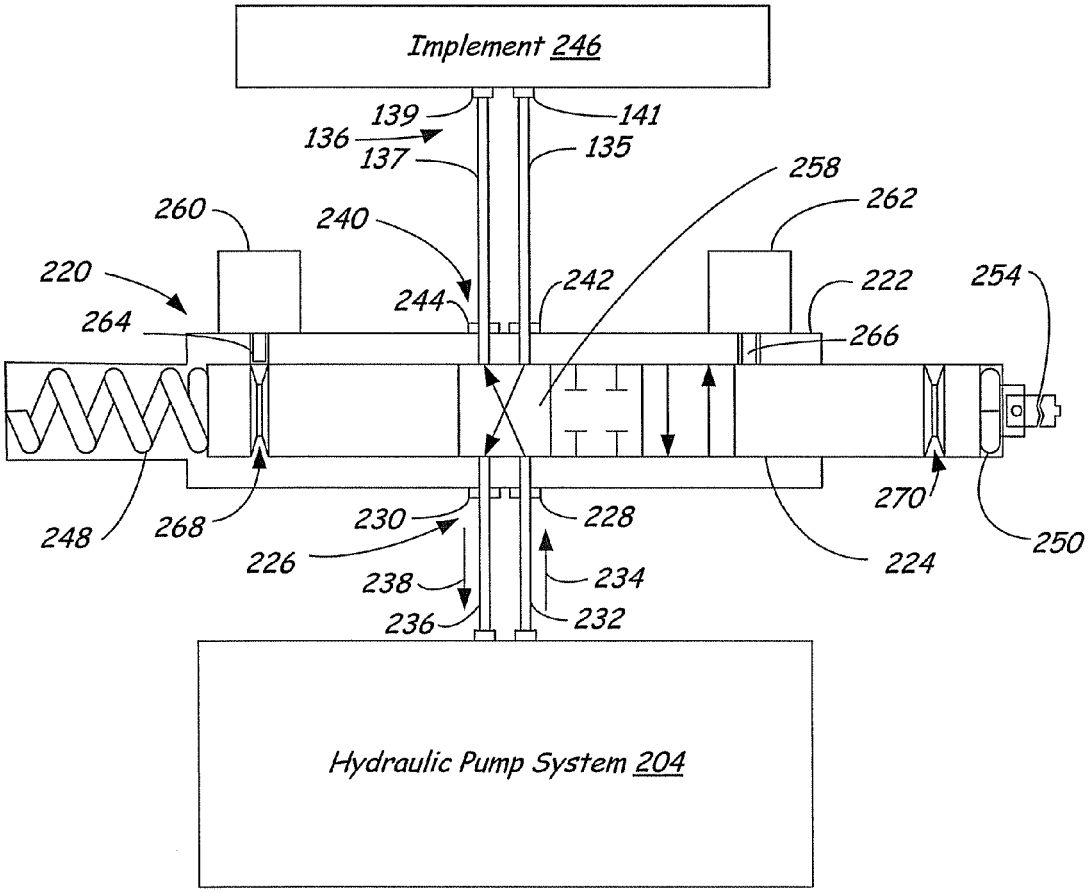
FIG. 8C is a schematic diagram of the control valve of FIG. 8A illustrating a spool valve in a second momentarily engaged position so as to allow the flow of a fluid through the valve in a direction opposite of that illustrated in FIG. 8B.

Conversely, FIG. 8C illustrates a condition where the linkage 254 applies a force that pulls the spool 224 against spring 250. In such a case, the spool 224 provides a path for hydraulic fluid to flow out to the implement 246 through port 244 and back from the implement through port 242. This is represented by symbol 258, which also represents the position of the spool 224. In such a case, hydraulic fluid is provided to the implement 246 in a direction opposing the direction shown in FIG. 8B. When fluid flows in either direction, the spool 224 can allow for metered flow of the hydraulic fluid, or alternatively, can allow only full flow when the fluid flows or no flow at all.

The linkage 254 described above and illustrated in FIGS. 8A-8C implies a solid mechanical link that is coupled to both the spool 224 and the auxiliary function input device 146. However, it should be appreciated that linkage 254 can be implemented in a variety of ways without departing from the spirit and scope of the discussion. For example, linkage 254 can be a push-pull cable. Alternatively still, linkage 254 can be an electrical or hydraulic signal supplied from the auxiliary function input device 146 that is coupled to the spool valve 220 that facilitates control of the position of the spool valve 220.

From the discussion above, one skilled in the art will appreciate that manipulation of the auxiliary function input device 146 controls movement of the spool 224, specifically away from the centered position illustrated in FIG. 8A. When an operator ceases to manipulate the auxiliary function input device 146, the spool 224 would, under normal circumstances, return to the centered position, thereby blocking the flow of hydraulic fluid to and from the implement 246. There may be times, however, when it is advantageous to have continuous flow of hydraulic fluid through the implement 246 in either of the directions illustrated in FIGS. 8B and 8C. For example, when using a mower, an operator may wish to have the mower blade turning continuously for an extended period of time. In such a case, it may be further advantageous for the spool 224 to remain in the desired position without requiring that an operator continuously manipulate the auxiliary function input device 146 when positioned immediately behind the distal end 112 of loader 10.

The spool valve 220 includes a pair of actuators 260 and 262, each of which is attached to the housing 220. The actuators 260 and 262 are coupled to wedges 264 and 266, respectively, as is illustrated in each of the FIGS. 8A-8C. In addition, the spool 224 has a pair of engagement features 268 and 270 located in either end of the spool. In one embodiment, the engagement features 268 and 270 are tapered notches formed into the surface of the spool 224. The engagement features 268 and 270 are capable of being engaged with the wedges 264 and 266 when the spool is positioned so that one of the wedges is aligned with one of the engagement features.

Figure 8D:
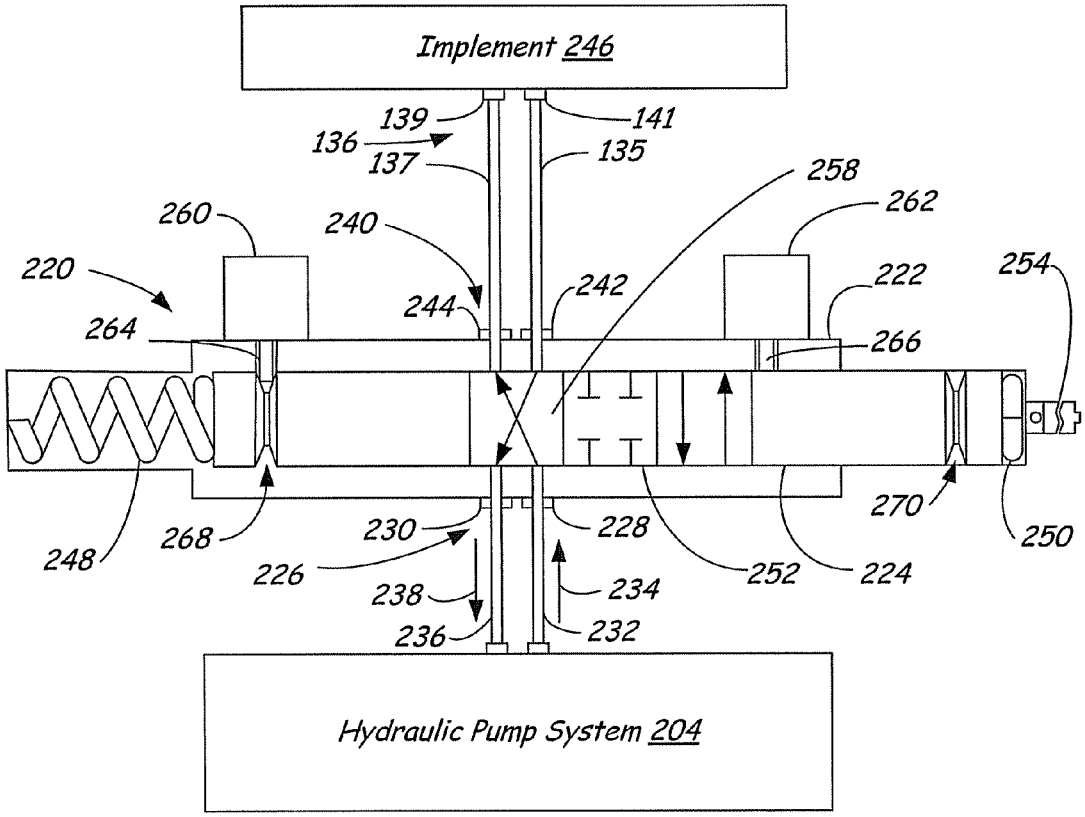
FIG. 8D is a schematic diagram of the control valve of FIG. 8A illustrating a spool valve in a continuously engaged position so as to allow the flow of a fluid through the valve in a direction opposite of that illustrated in FIG. 8B.

FIG. 8D illustrates the spool valve 220 with its valve spool positioned such that the valve 220 is in a continuous flow condition according to one illustrative embodiment. The spool 224 is positioned so that it has compressed the spring 248. In addition, wedge 264 extends into the engagement feature 268 in spool 224 to prevent the spool 224 from returning to the centered position until the wedge 264 is retracted out of the engagement feature 268. When the wedge 264 is thus positioned, the hydraulic pump system 204 can provide continuous hydraulic flow through the hydraulic control valve 210 to an implement. In one illustrative embodiment, the wedge 264 is controlled by actuator 260, which causes the wedge 260 to extend or retract, depending on a signal provided to it by the actuator 260. Similarly, wedge 266 is controlled by an actuator 262 so that when it is desirable to have continuous flow in the opposing direction to that illustrated in FIG. 8D, wedge 266 can be extended to engage engagement feature 270 in the spool 224 when the spool 224 is properly positioned.

The actuators 260 and 262, in one illustrative embodiment, are electric actuators, such as solenoids, which receive electrical signals that control the position of their respective wedges. A first signal sent to the actuators 260 and 262 urges the actuators to retract their associated wedges. A second signal sent to of the actuators 260 and 262 urges the actuators to attempt to extend their associated wedges.

Figure 9:
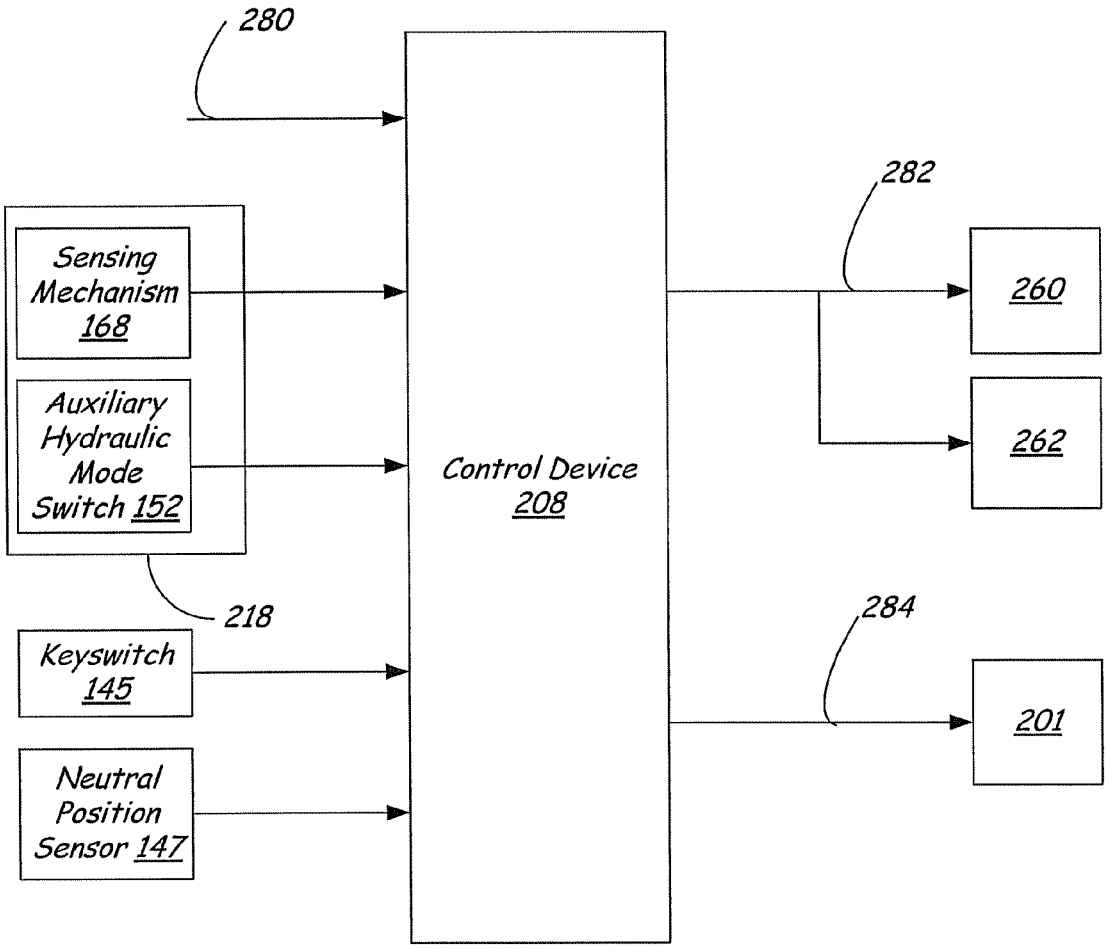
FIG. 9 is a block diagram illustrating a control system for controlling a continuous engagement feature for providing continuous hydraulic flow through a valve in accordance with one illustrative embodiment.

As is detailed in FIG. 8D, the hydraulic control valve 210 can be placed in a condition where continuous hydraulic flow is provided to an implement. FIG. 9 provides an illustration of the control device 208 according to one embodiment of the present discussion, which illustratively provides control of the positioning of spool 224 and the positioning of wedges 264 and 266. The control device 208 receives inputs from an operator actuable continuous actuation device and provides one of the signals 218 to the spool valve 210. An enablement input 280 provides a power source for the control device 208. The control device 208 also receives inputs from a sensing mechanism 168, which illustratively provides an indication of the position of the drive handle 142, the keyswitch 145, a neutral position sensor 147, and the auxiliary hydraulic mode switch 152. The neutral position sensor 147 in one illustrative embodiment, provides a signal indicative of whether the spool 224 is in the centered position and therefore blocking any flow of hydraulic fluid to the implement 246.

The control device 208 provides an output signal 282 to the actuators 260 and 262 and an output signal 284 to the starter 201 based upon the status of the inputs received by the control device 208. It should be appreciated that the control device 208, while shown here as a single device, may actually be more than one device. For example, a separate control device from the one that provides the output signal 282 may be incorporated that provides output signal 284 to the starter 201.

If the output signal 282 is an engagement signal, the actuators 260 and 262 will allow wedges 264 and 266 to attempt to engage engagement features 268 and 270. In one embodiment, the wedges 264 and 266 will engage their respective engagement features 268 and 270, only when the spool 224 is positioned to allow one of the wedges to engage, as is shown in FIG. 8D. Otherwise, either or both of the wedges 264 and 266 will engage the spool 224 along a portion of the surface of the spool. If the spool 224 is not aligned so that either of the wedges 264 and 266 are capable of engaging one of their respective engagement features 268 and 270, automatic continuous flow will not be provided. Thus, if the operator does not apply a force via the auxiliary function input device 146, the springs in the spool valve will tend to urge the spool 224 to a neutral position as shown in FIG. 8A. If, however the engagement signal is provided and the spool 224 is subsequently manipulated to position one of the engagement features 268 or 270 inline with its corresponding wedge, the wedge will be capable of engaging the spool 224 and allowing continuous hydraulic flow to an implement. Alternatively, if the output signal 282 is a disengagement signal, the actuators 260 and 262 will endeavor to position the wedges 264 and 266 so that they do not engage the engagement features even if one of the wedges is aligned with one of the engagement features. It is possible, in some embodiments, for an operator to apply sufficient force via the auxiliary function input device 146 to force one of the wedges that is engaging its engagement feature out of the engagement feature and thereby ending the continuous flow condition. If the engagement signal is still being applied, a subsequent realignment of one of the wedges with its respective engagement feature will allow the wedge to re-engage the engagement feature and thus provide a continuous flow condition once again.

In one embodiment, the actuators 260 and 262 are biased so that the disengagement signal is actually an absence of a signal. Thus, with no signal, the wedges 264 and 266 are positioned away from the spool 224 so that the wedges will not engage the engagement features 268 and 270, even if one of the wedges are positioned inline with a corresponding wedge. For example, the wedges 264 and 266, in one embodiment, are spring loaded so that they are drawn toward the actuators 260 and 262 and the application of a signal 282 causes the wedges to move away from the actuators 260 and 262 and toward the spool 224.

Functional embodiments of the control device 208 will be discussed in more detail below. It should be appreciated, though, that the control device 208 can include various electrical and/or electronic components. For example, control device 208 can include logic devices, microcontrollers, microprocessors, relays, timers, output driving circuitry, and the like. Any suitable electrical or electronic, electromechanical, or mechanical system can be implemented. One suitable embodiment includes a plurality of relays that are controlled by signals provided by the sensing mechanism 168 and the auxiliary hydraulic mode switch 152 so that, under suitable conditions as described below, the power source provided by enablement input 280 is directed to the actuators 260 and 262.

Figure 10:
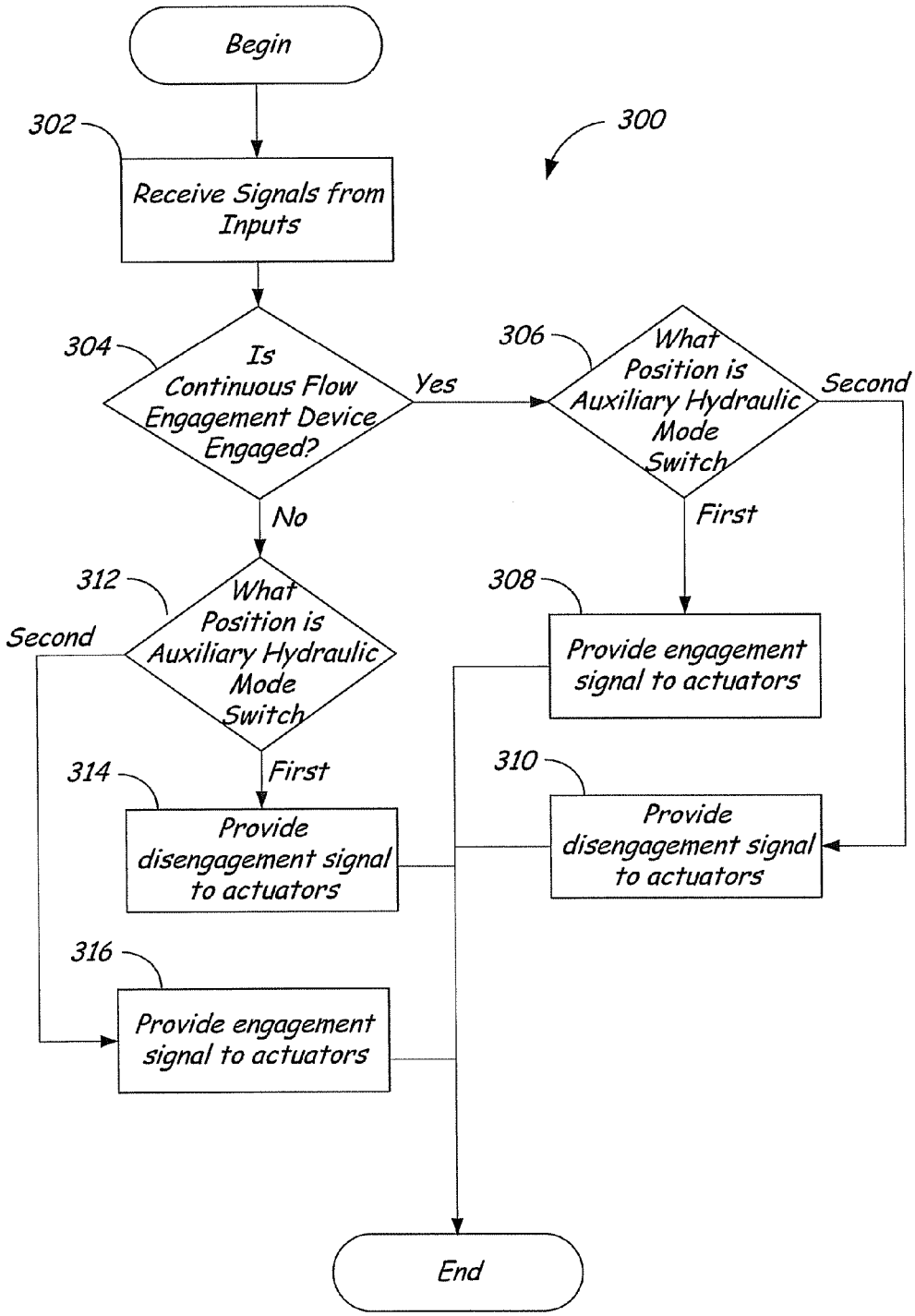
FIG. 10 is a flowchart illustrating a method of providing continuous hydraulic flow to an implement according to one illustrative embodiment.

FIG. 10 illustrates a method 300 of providing continuous flow to an implement coupled to loader 10 according to one illustrative embodiment. As part of method 300, the control device 208 receives signals indicative of the status of the continuous flow engagement device 150 and the auxiliary hydraulic mode switch 152. This is illustrated in block 302. At decision block 304, if the signals received indicate that the continuous flow engagement device 150 is in an engaged position, the method moves to block 306. At decision block 306, the status of the signal indicative of the position of the auxiliary hydraulic mode switch 152 is examined. As discussed above, the auxiliary hydraulic mode switch 152 is illustratively a two-position switch. A first position indicates that the continuous flow feature of the auxiliary hydraulics of loader 10 is intended to be operated in a non-stationary position, that is, that the loader 10 is intended to be moved by either or both of the traction drive systems 102 and 104. A second position indicates that the continuous flow feature of the auxiliary hydraulics of loader 10 is intended to be operated in a stationary position. If the signal from the auxiliary hydraulic mode switch 152 is indicative of the first of the two positions, the control device 208 provides an engagement signal 282 to the actuators 260 and 262. This is illustrated at block 308. If the signal from the auxiliary hydraulic mode switch 152 is indicative of the second of the two positions, the control device 208 provides a signal 282 indicative of disengagement to the actuators 260 and 262. This is illustrated at block 308.

Returning to block 304, if is it determined that continuous flow engagement device 150 is in an disengaged position, the method moves to block 312 and the status of the signal indicative of the position of the auxiliary hydraulic mode switch 152 is examined. If the signal from the auxiliary hydraulic mode switch 152 is indicative of the first of the two positions, the control device 208 provides a signal 282 to the actuators 260 and 262 indicative of disengagement. This is illustrated at block 314. If the signal from the auxiliary hydraulic mode switch 152 is indicative of the second of the two positions, the control device 208 provides a signal 282 indicative of engagement to the actuators 260 and 262. This is illustrated at block 316. Thus, the position of the auxiliary hydraulic mode switch 152 illustratively causes the control device 208 to change the response to the continuous flow engagement device 150.

Figure 11:
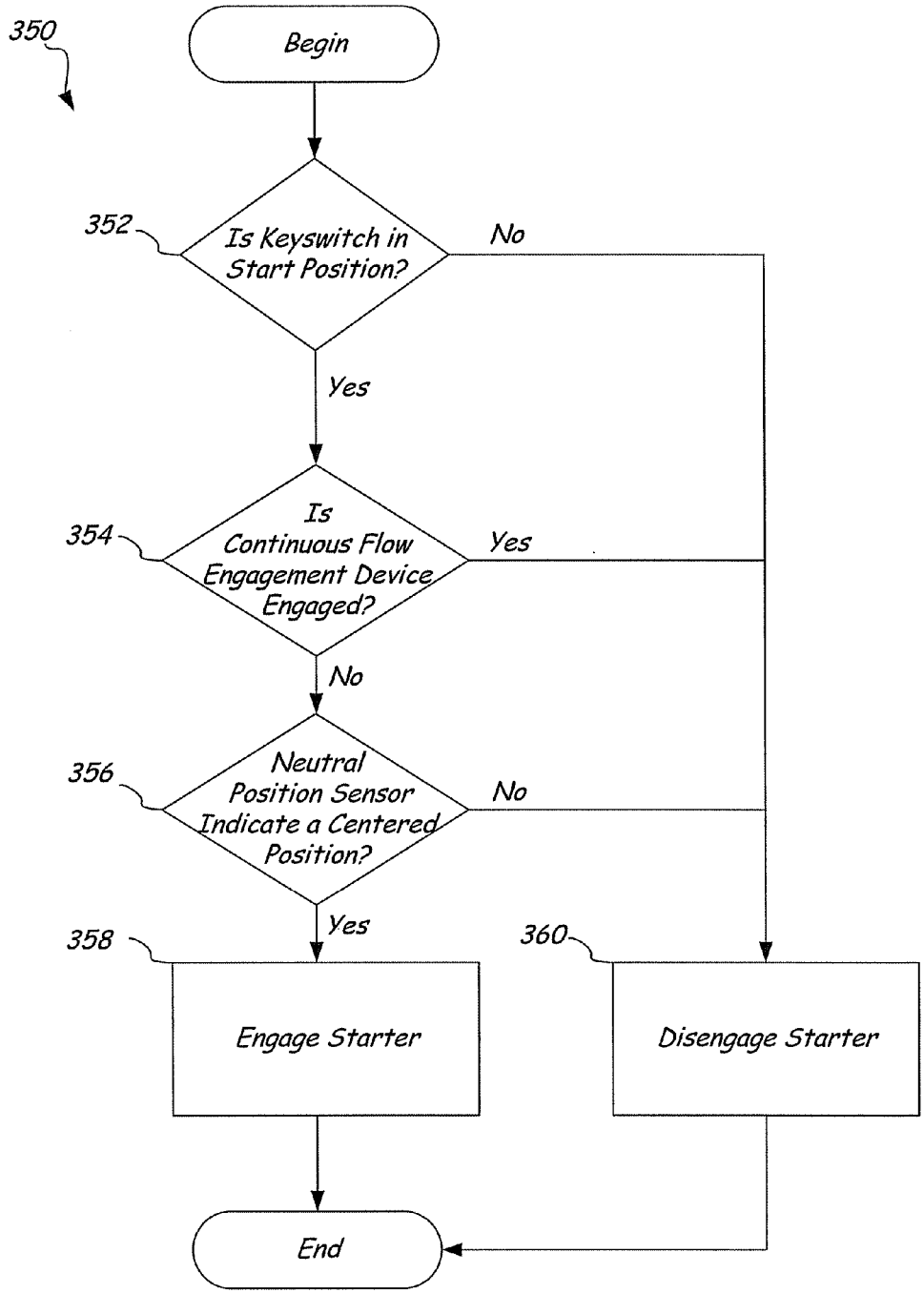
FIG. 11 is a flowchart illustrating a method of controlling an engagement signal to a starter for the loader of FIG. 1 according to one illustrative embodiment.

FIG. 11 illustrates a method 350 of controlling the starter 201 according to one illustrative embodiment. At block 352, if the keyswitch 145 is in the start position, the status of the continuous flow engagement device 142 is considered. As discussed above, the status of the continuous flow engagement device is monitored by sensing mechanism 168 and in one embodiment, a signal from sensing mechanism 168 is indicative of the position of the continuous flow engagement device 142. This is illustrated at block 354. If the continuous flow engagement device 142 is in the disengaged position, the signal from the neutral position sensor 147 is considered. This is indicated at block 356. If the signal from the neutral position sensor 147 indicates that the spool 224 is in a centered position, a signal to start the loader 10 is provided to the starter 201. This is illustrated at block 358. If, at block 352, the keyswitch 145 is not in the start position, or if at block 354, the continuous flow engagement device 142 is in the engaged position, or if at block 356, the neutral position sensor 147 indicates that the spool 224 is not in a centered position, the starter is not sent a signal to start the engine 202. This is illustrated at block 360. As discussed above, in one embodiment control device 208 receives input signals from sensing mechanism 168, the keyswitch 145, and the neutral position sensor 147. Control device 208, in one embodiment, includes a plurality of relays that are controller by the sensing mechanism 168, the keyswitch 145, and the neutral position sensor 147 so that the power source provided by enablement input 280 is directed to the starter 201 under conditions described above and illustrated in FIG. 11.

The discussion above lays out important advantages. Methods and systems disclosed above provide for a continuous flow engagement system for vehicles such as walk behind loaders that provide the ability to continuously engage auxiliary hydraulic functions if an operator properly manipulates input devices on the control panel. Such systems and methods allow for differing modes of operation, based on the status of different devices. Although, specific embodiments are disclosed above, it should be understood that the embodiments are illustrative in nature. Other embodiments that are within the spirit and similar to those presented here will be apparent to those skilled in the art.

What is claimed:

1. A hydraulic system for a loader configured to provide hydraulic fluid to an implement attached to the loader, the hydraulic system comprising:

a valve having a de-actuated position, which blocks hydraulic fluid from being supplied to the implement and an actuated position, which allows hydraulic fluid to be supplied to the implement, wherein the valve has a bias toward the de-actuated position;

an actuator, operably coupled to the valve, and capable of being manipulated to overcome the bias and cause the valve to move from the de-actuated position to the actuated position;

an enabling member input device movable from a loader operating position between an engaged position and a disengaged position and configured to provide an enablement signal indicative of the position of the enabling member;

a mode input having an actuable member capable of being moved from a first position to a second position and capable of providing a signal indicative of the position of the actuable member;

a continuous engagement member, capable of engaging the valve when the valve is in the actuated position to encourage the valve to remain in the actuated position while the continuous engagement member is engaged with the valve;

a control device configured to receive signals from the mode input and the enabling member and to provide an engagement signal to the continuous engagement member; and wherein the control device is configured to provide an engagement signal to the continuous engagement member causing the engagement member to attempt to engage the valve when the enablement signal is indicative of the engaged position and the mode input is indicative of a first position and when the enablement signal is indicative of the disengaged position and the mode input is indicative of the second position.

2. The hydraulic system of claim 1 wherein the continuous engagement member is configured to attempt to disengage the valve when the signal provided by the mode input is indicative of a second position and the enablement signal is indicative of the engaged position.

3. The hydraulic system of claim 1 wherein the continuous engagement member is configured to attempt to disengage the valve when the signal provided by the mode input is indicative of a first position and the enablement signal is indicative of the disengaged position.

* * * * *